US006448878B1

(12) United States Patent
Mullins et al.

(10) Patent No.: US 6,448,878 B1
(45) Date of Patent: Sep. 10, 2002

(54) IGNITION COIL ASSEMBLY

(75) Inventors: David H. Mullins, Nicholasville, KY (US); Hayato Koguchi, Harrodsburg, KY (US)

(73) Assignee: Hitachi Automotive Products (USA), Inc., Harrodsburg, KY (US)

( * ) Notice: Subject to any disclaimer, the term of this patent is extended or adjusted under 35 U.S.C. 154(b) by 0 days.

(21) Appl. No.: 09/532,680

(22) Filed: Mar. 21, 2000

(51) Int. Cl.[7] ..... H01F 27/02

(52) U.S. Cl. ..... 336/90; 336/92; 336/96; 336/178; 336/212; 336/234

(58) Field of Search ..... 336/96, 83, 110, 336/212, 234, 90, 92, 198, 192, 178

(56) References Cited

U.S. PATENT DOCUMENTS 5,703,556 A * 12/1997 Kikuta et al. ..... 336/83
5,778,863 A * 7/1998 Oosuka et al. ..... 123/634
6,211,765 B1 * 4/2001 Ito et al. ..... 336/178

FOREIGN PATENT DOCUMENTS

JP 360054417 A * 3/1985

* cited by examiner

*Primary Examiner*—Lincoln Donovan
*Assistant Examiner*—Tuylen T. Nguyla
(74) *Attorney, Agent, or Firm*—Gifford, Krass, Groh, Sprinkle, Anderson & Citkowski, P.C.

(57) ABSTRACT

An ignition coil assembly is disclosed for a spark plug of the type used in internal combustion engines. The ignition assembly includes a housing, a tubular and cylindrical primary coil, and a tubular and cylindrical secondary coil. The primary and secondary coils are each wound on their individual bobbins and the bobbins are mounted in the housing such that the primary coil is coaxially positioned inside the secondary coil. The ignition coil assembly further includes a magnetic core having a first portion which extends through the interior of both the primary and secondary coil and a second portion which extends exteriorly of the primary and secondary coils. The first portion of the coil is substantially circular in cross sectional shape thus matching the circular interior of the primary bobbin. In order to construct the primary coil and secondary coil subassembly, the primary bobbin is first positioned on a winding machine and the primary wire is wound on the bobbin. Thereafter, the secondary bobbin is positioned over the primary bobbin and the wire for the secondary coil is then wound by the winding machine.

19 Claims, 5 Drawing Sheets

IGNITION COIL ASSEMBLY

BACKGROUND OF THE INVENTION

I. Field of the Invention

The present invention relates generally to ignition coil assemblies for spark plugs of the type used in internal combustion engines and, more particularly, to an ignition coil assembly of the type used with individual spark plugs.

II. Description of the Prior Art

In the automotive industry, there has been an increased use of distributorless ignition systems in recent years. Such distributorless ignition systems have, in turn, caused an increased use of individual ignition coils for each spark plug of the engine. For example, for a four cylinder engine. four separate ignition coils are utilized. The use of individual ignition coils per spark plug in practice reduces the overall weight of the automobile by eliminating the previously used bulky and heavy single ignition coil used to fire all of the spark plugs in the engine.

The use of individual ignition coils per spark plug enables the ignition coil assembly to be relatively compact and lightweight. Such ignition coils may be mounted around their respective spark plugs in the engine cavity or, alternatively, above the spark plugs and connected to the spark plugs by a suitable electrical connector.

The previously known ignition coil assemblies for individual spark plugs typically comprise a primary coil and a secondary coil in which one coil is nested within the other coil. Typically, the primary coil and secondary coil each comprises a bobbin having the coil wire wound about the bobbin. After the primary and secondary coil wires have been wound about their bobbin, one of the bobbins is coaxially positioned within the other bobbin such that the bobbins are coaxial with each other.

A magnetic core is also conventionally employed to enhance the magnetic coupling between the primary and secondary bobbins. These previously known cores typically comprise a first portion which extends through the primary and secondary coils and a second portion which extends exteriorly around the primary and secondary coils to complete the magnetic circuit. Conventionally, these magnetic cores are constructed from laminated steel in which the laminations are secured together in any conventional fashion.

Each lamination of these previously known magnetic cores is substantially identical in shape to each other so that a single die can be used to stamp laminations for the magnetic core from sheet metal. The use of identical laminations to form the magnetic core results in inexpensive manufacture and assembly costs for the magnetic core. Furthermore, since the laminations for the magnetic core are substantially identical to each other, the cross sectional shape of the magnetic core, once constructed from the multiple laminations, is necessarily rectangular in cross sectional shape.

One disadvantage of these previously known magnetic cores is that the cross sectional shape of the portion of the magnetic core extending through the primary and secondary coils necessarily results in a less than satisfactory magnetic coupling between the primary and secondary coils. For example, if the bobbins for the primary and secondary coil are circular in shape, a space is necessarily created between the sides and top of the magnetic core and the interior of the primary or secondary coil bobbin. Such spacing reduces the efficiency of the magnetic coupling between the primary and secondary coils.

In order to increase the efficiency of the magnetic coupling between the magnetic core and the primary and secondary coils, there have been previously known ignition systems in which the bobbins for the primary and secondary coil are essentially rectangular or square in cross sectional shape so that the interior of the inside bobbin is substantially the same size, or slightly greater than, the cross sectional size of the magnetic core. While such construction increases the efficiency of the magnetic coupling between the coils by reducing the spacing between the top and sides of the magnetic core and the coils, the use of rectangular or square bobbins for the primary and secondary coils creates manufacturing difficulties for winding the primary and secondary bobbins since it is desirable to maintain a constant tension on the wires for the primary and secondary coils during the winding operation. Such wire tension is difficult to maintain when the bobbins have a square or rectangular cross sectional shape.

A still further disadvantage of the previously known ignition coil assemblies in which the primary and secondary bobbins have a square or rectangular cross sectional shape is that the magnetic coupling between the primary and secondary coils is less efficient than obtainable if the primary and secondary coils are circular in cross sectional shape.

SUMMARY OF THE PRESENT INVENTION

The present invention provides an ignition coil assembly which overcomes all of the above-mentioned disadvantages of the previously known devices.

In brief, the ignition coil assembly of the present invention is adapted to be used with a single spark plug so that each spark plug in the internal combustion engine utilizes its own ignition coil assembly. The ignition coil assembly comprises a housing which is mounted in the engine compartment.

In order to construct the ignition system assembly, the primary wire which forms the primary coil is first wound on a tubular and cylindrical primary coil bobbin on a wire winding machine. Since the primary coil bobbin is circular in cross sectional shape, the primary wire may be rapidly wound on the bobbin while maintaining a constant tension on the primary wire so that the primary coil, once wound, has a circular cross sectional shape.

With the primary coil bobbin still on the winding machine, following completion of winding the primary coil, a tubular and cylindrical secondary coil bobbin is positioned coaxially over the primary bobbin and the secondary wire which forms the secondary coil is then wound around the secondary bobbin. Following completion of winding the secondary coil, the primary and secondary coil subassembly is then positioned within a receiving cavity in the housing.

The ignition coil assembly of the present invention further comprises a magnetic core having a first portion extending coaxially through the primary and secondary coil subassembly. A second portion of the magnetic core extends exteriorly around the primary and secondary coil subassembly to the opposite ends of the first portion of the magnetic core thus completing the magnetic circuit. The entire magnetic core, furthermore, is constructed in two or more sections to enable assembly of the magnetic core to the housing.

The magnetic core is constructed from a number of steel laminations which are secured together in any conventional fashion. Unlike the previously known magnetic cores, however, the width of the laminations along the first portion of the magnetic core vary from the top to the bottom of the magnetic core such that the cross sectional shape of the first portion of the magnetic core is substantially circular and of the same size or slightly less than the inside diameter of the primary core bobbin. Thus, since the shape of the portion of the magnetic core extending through the primary and secondary coil subassembly is substantially the same as the inside diameter of the primary coil bobbin, enhanced magnetic coupling between the primary and secondary coils is obtained.

Following assembly of both the primary and secondary coil subassembly and the magnetic core to the housing, a potting material, such as epoxy, is utilized to seal the coils and other components of the ignition coil assembly to protect the ignition coil assembly from the environment.

Appropriate electrical connections are then made between the coils, an igniter, the spark plug and the engine battery.

BRIEF DESCRIPTION OF THE DRAWINGS

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
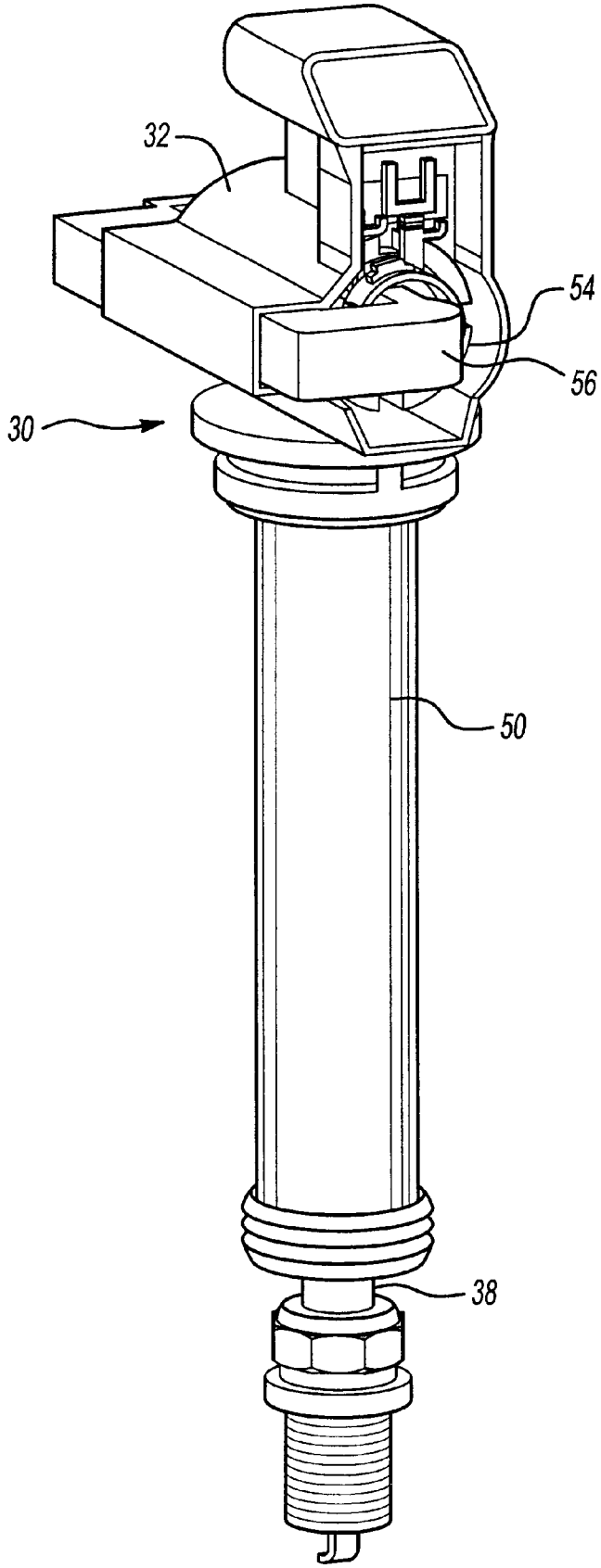
FIG. 1 is a perspective view illustrating a preferred embodiment of the present invention.
Figure 2:
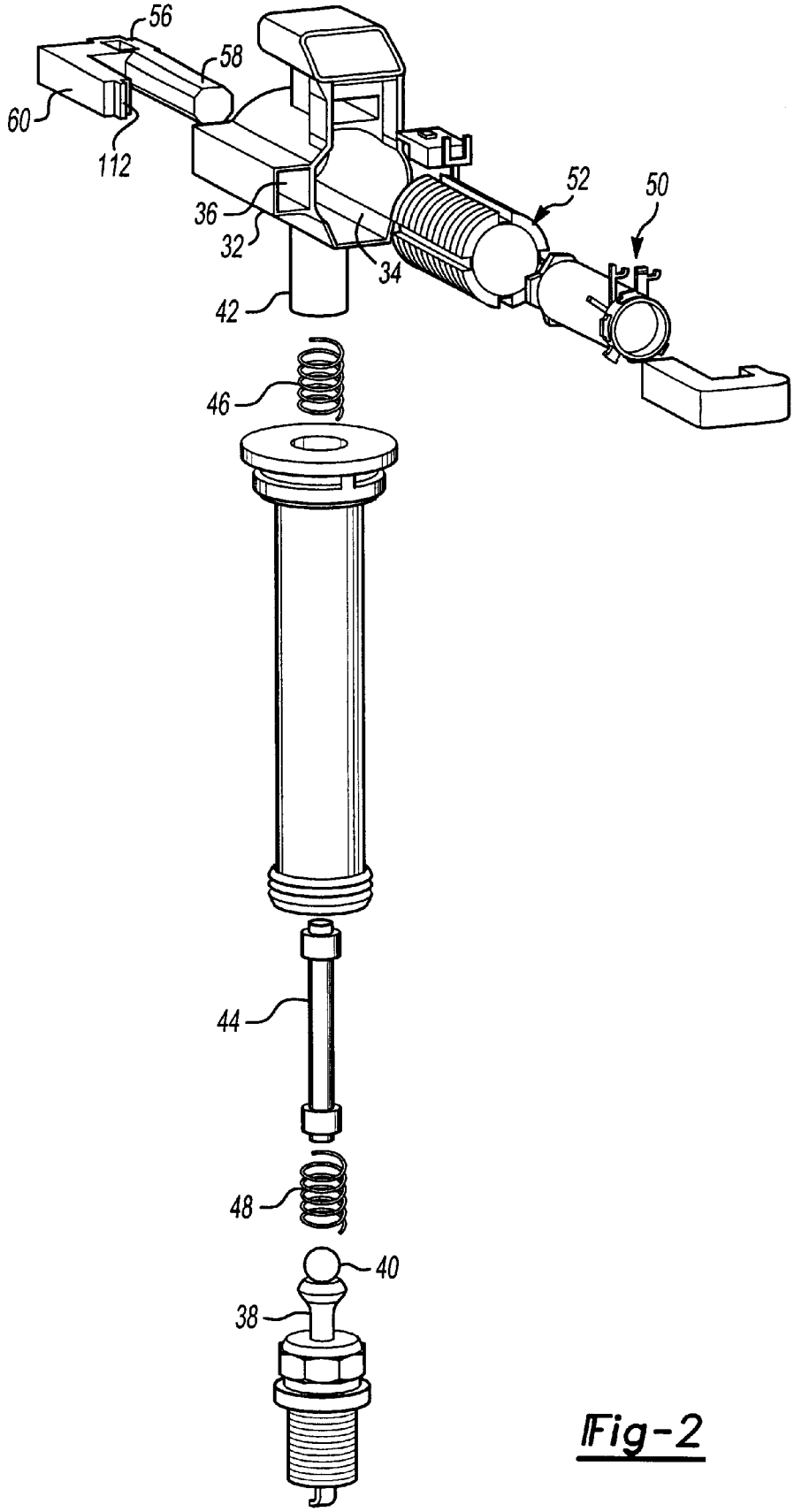
FIG. 2 is an exploded view of a preferred embodiment of the present invention.

With reference first to FIGS. 1 and 2, a first preferred embodiment of the ignition coil assembly 30 of the present invention is there shown and comprises a housing 32 having a main cylindrical cavity 34 and a square through cavity 36. The housing 32 is constructed of any conventional material, such as plastic.

The ignition coil assembly 30 is designed for use with a single spark plug 38 having a terminal 40. A metal terminal 42 connected to the housing 32 is electrically connected to the spark plug terminal 40 by a metal rigid rod 44 and compression springs 46 and 48. A protective rubber boot 50 is disposed around the metal rod 44 to electrically insulate the metal connection between the housing terminal 42 and the spark plug terminal 40.

Referring now particularly to FIG. 2, the ignition coil assembly 30 further comprises a primary coil assembly 50 which is coaxially disposed within a secondary coil assembly 52 and the primary coil and secondary coil subassembly 54 is then positioned within the cylindrical cavity 34 of the housing 32 to the position shown in FIG. 1. A magnetic core 56 includes a first portion 58 which is coaxially disposed through the primary and secondary coil subassembly 54 and a second portion 60 which is disposed through and secured to the housing square channel 36. The construction of the magnetic core 56 will be subsequently described in greater detail.

The ignition coil assembly 30 further includes an igniter module 62. This igniter module 62 is mounted to the housing 32 and controls the firing of the spark plug 38 in the conventional fashion.

Figure 3:
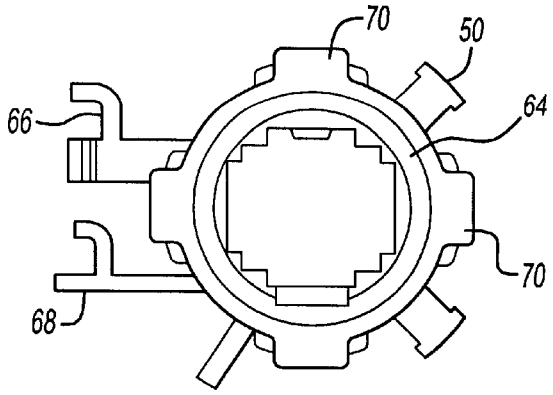
FIG. 3 is an end view of the primary bobbin of the present invention.
Figure 4:
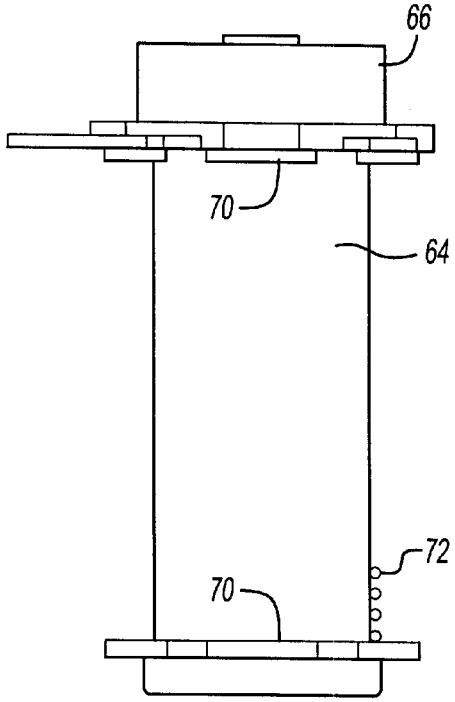
FIG. 4 is a side view of the primary coil bobbin of the present invention.

With reference now to FIGS. 3 and 4, the primary coil assembly 50 is there shown in greater detail and comprises a bobbin 64 which is tubular and cylindrical in shape. The bobbin 64 is constructed of an electrically nonconductive material, such as plastic, and includes a pair of electric terminals 66 and 68 which are embedded in the bobbin 64. As best shown in FIG. 3, the bobbin 64 includes at least one, and preferably four circumferentially spaced mounting tabs 70 which extend radially outwardly from the bobbin 64 at opposite ends of the bobbin 64. In order to construct the primary coil assembly 50, the bobbin 64 is mounted on a conventional wire winding machine and the wire 72 which forms the primary coil is wound around the bobbin 64 between the ends of the bobbin 64. The ends of the wire 72 are electrically connected to the terminals 66 and 68 in any conventional fashion.

Figure 5:
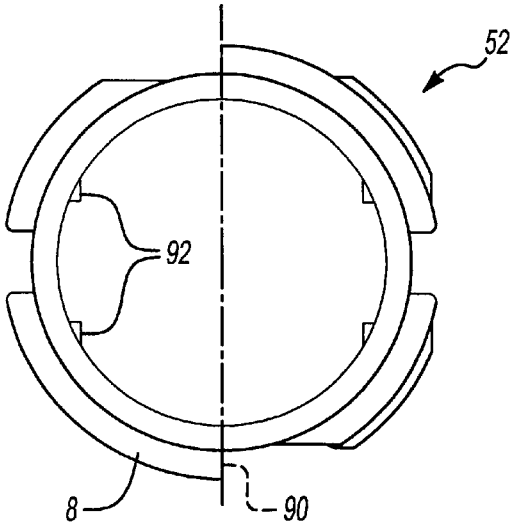
FIG. 5 is an end view of the secondary coil bobbin.
Figure 6:
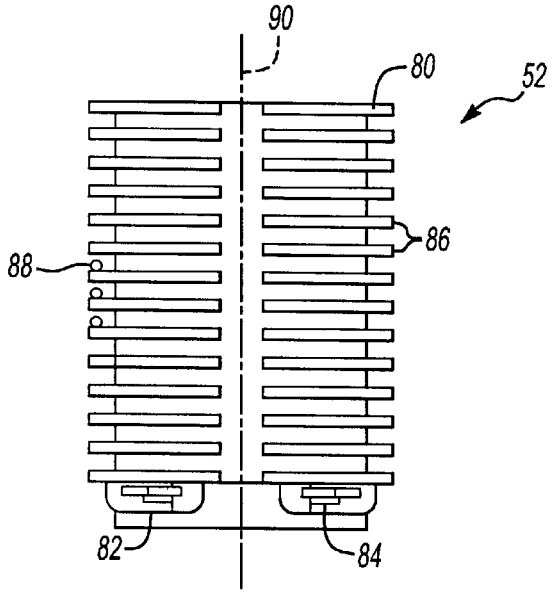
FIG. 6 is a side view of the secondary coil bobbin.

With reference now to FIGS. 5 and 6, the secondary coil assembly 52 is there shown in greater detail and includes a tubular and cylindrical bobbin 80 which is constructed of an electrically nonconductive material, such as plastic. A pair of terminals 82 and 84 are embedded in one end of the bobbin 80.

Still referring to FIGS. 5 and 6, the bobbin 80 includes a plurality of radially outwardly extending, axially spaced and circumferentially extending ribs 86 along its outer periphery to facilitate winding the secondary coil wire 88 around the bobbin 80. The ends of the wire 88 are connected to the terminals 82 and 84 in any conventional fashion. Furthermore, at least one, and preferably several circumferentially spaced and longitudinally extending channels 90 are formed through the ribs 86 to facilitate the flow of a potting material, such as an epoxy.

With reference now particularly to FIG. 5, a plurality of radially inwardly and longitudinally extending alignment ribs 92 are provided on the inside diameter of the bobbin 80. These ribs 92 cooperate with the locating tab 70 (FIGS. 3 and 4) on the primary coil assembly 50 to angularly align the primary coil 50 with the secondary coil 52.

In constructing the primary and secondary coil subassembly 54, the primary coil bobbin 64 is first positioned on a wire winding machine and the primary coil wire 72 is then wound around the exterior surface of the bobbin 64. After winding of the primary coil assembly 50, the secondary coil bobbin 80 is positioned over the primary coil assembly 50 and the secondary coil wire 88 is then wound around the secondary coil bobbin 80 on the winding machine thus facilitating the overall assembly of the primary and secondary coil subassembly 54.

Figure 7:
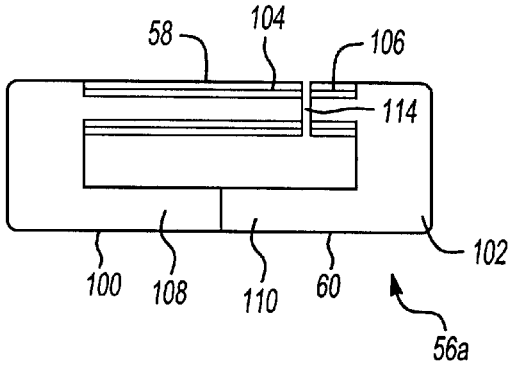
FIGS. 7–12 are side views illustrating different embodiments of the magnetic core for the ignition coil assembly.

With reference now to FIGS. 7–12, different embodiments of the magnetic core 56 sequentially numbered **56*a*–56*f* for differentiation are there shown. In FIG. 7, the magnetic core 56*a* is constructed from two sections 100 and 102, each of which is generally U-shaped. As such, one end of each core section 100 and 102 is generally circular in cross sectional shape to form the first portion 58 of the magnetic core 56. Conversely, the opposite ends of the sections 100 and 102 are joined together, preferably by a spline 112 (FIG. 2) to form the second portion 60 of the magnetic core 56*a*. Furthermore, the ends 104 and 106 of the core sections 100 and 102, respectively, are perfectly spaced apart from each other to form an air gap 114**.

Figure 8:
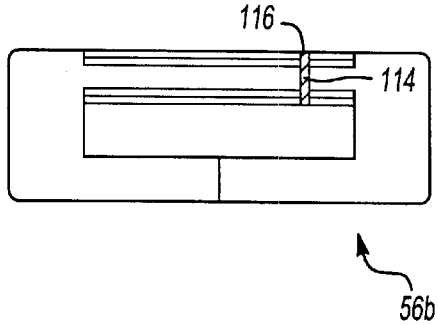

With reference now to FIG. 8, the magnetic core 56*b* is substantially identical to the magnetic core 56*a* (FIG. 7) except that a permanent magnet 116 is disposed in the air gap 114. Preferably, this permanent magnet 116 is a rare earth magnet.

Figure 9:
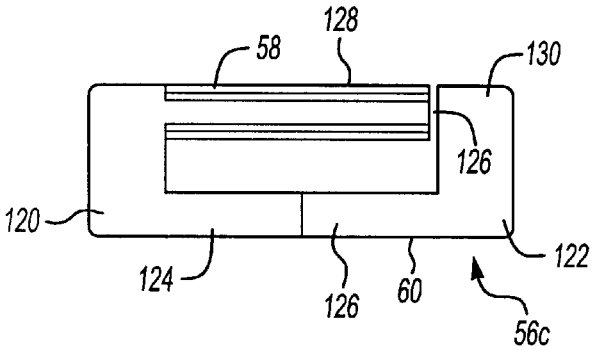

With reference now to FIG. 9, the magnetic core 56*c* is there shown in which one core section 120 is generally U-shaped while a second core section 122 is generally L-shaped. The first portion 58 of the magnetic core 56, i.e. the portion of the magnetic core extending through the primary and secondary coil subassembly 54, is formed entirely by the first core section 120. The ends 124 and 126 of the core sections 122 and 124 which form the second or square cross sectional portion 60 of the magnetic core 56*c* are joined together so that an air gap 126 is formed between the opposite end 128 of the first core section 120 and the second end 130 of the second core section 122.

Figure 10:
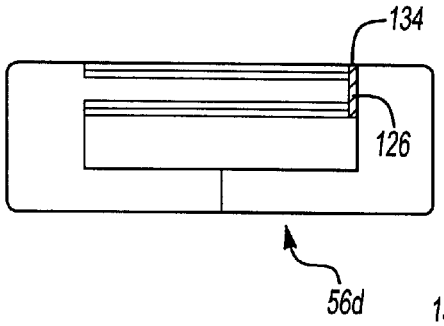

With reference now to FIG. 10, a still further modification of the magnetic core 56 is there illustrated. The magnetic core 56 is substantially identical to the magnetic core 56*c* illustrated in FIG. 9 except that a permanent magnet 134 is disposed within the air gap 126. Preferably, this magnet 134 is a rare earth magnet.

Figure 11:
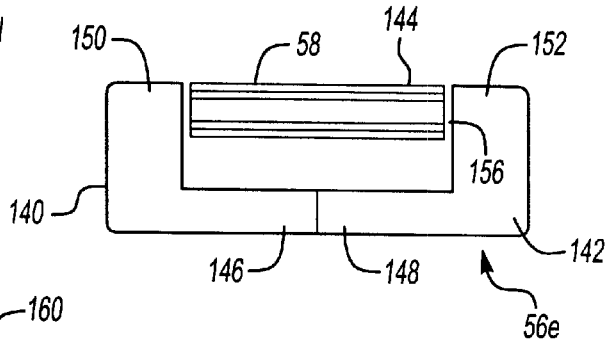

With reference now to FIG. 11, the magnetic core 56*e* is constructed from three separate sections 140, 142 and 144. The core section 144 is elongated and generally cylindrical in shape and forms the first portion 58 of the magnetic core 56, i.e. the portion of the core 56*e* which extends through the primary and secondary coil subassembly 54. The other two core sections 140 and 142 are generally L-shaped and have a rectangular cross sectional shape. Two ends 146 and 148 of the core sections 140 and 142, respectively, are secured together, preferably by a spline 112 (FIG. 2) while the opposite ends 150 and 152 of the core sections 140 and 142, respectively, are positioned adjacent, but spaced from opposite ends of the core section 144 thus forming two air gaps 156 with one air gap 156 at each end of the first core section 144.

Figure 12:
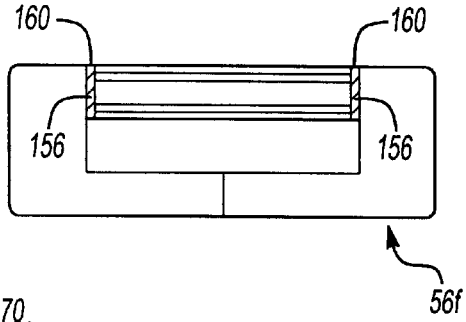

With reference now to FIG. 12, the core section 56 is substantially identical to the core section 56*e* illustrated in FIG. 11 except that a permanent magnet 160 is positioned in one or both of the air gaps 156. These permanent magnets 160 are preferably of a rare earth magnet.

Figure 13:
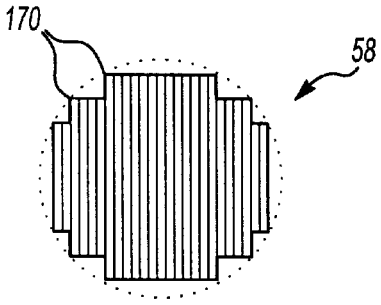
FIGS. 13–16 are all cross sectional views illustrating different modifications of the magnetic core for the ignition coil assembly.

With reference now to FIG. 13, a cross section of a first preferred embodiment of the first portion 58 of the magnetic core 56 is there shown, i.e. the portion of the magnetic core 56 which extends through the primary and secondary coil subassembly 54. As shown in FIG. 13, the magnetic core is formed from metal laminations 170 having three different widths with the narrowest of the width on the outside of the core portion 58 and the widest width at the center portion of the core 58. Thus, the cross section of the magnetic core portion 58 approximates a circle.

Figure 14:
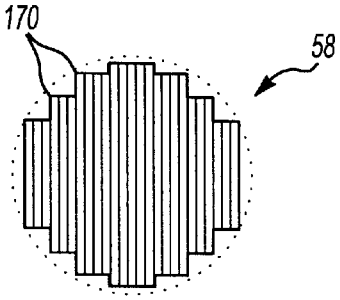

With reference now to FIG. 14, a modification of the first portion 58 of the magnetic core 56 is there shown. The embodiment of the core portion 58 illustrated in FIG. 14 is substantially identical to the core illustrated in FIG. 13 except that the metal laminations 170 are in four different widths with the narrowest width at the outside of the core portion 58 and the widest width at the center of the core portion 58. Consequently, the core portion 58 illustrated in FIG. 14 more closely resembles a circular cross sectional shape than the core portion illustrated in FIG. 13 thereby increasing the overall magnetic efficiency of the core portion 58.

Figure 15:
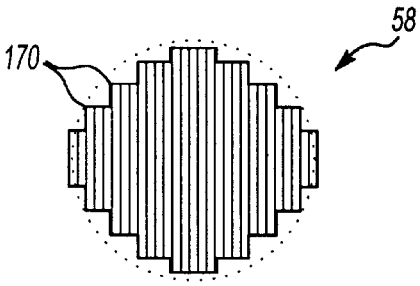

With reference now to FIG. 15, a still further embodiment of the core portion 58 is shown in which the metal laminations 170 are of five different widths. As such, the cross sectional shape of the core portion 58 in FIG. 15 more closely resembles a circular shape than the core portions of FIGS. 13 and 14. Consequently, the core portion 58 of FIG. 15 is magnetically more efficient than the core portions 58 of FIGS. 13 and 14.

Figure 16:
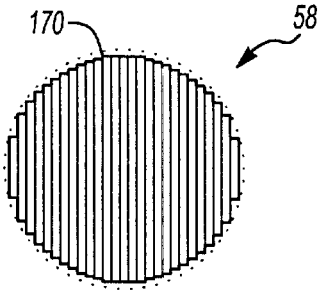

Lastly, with reference now to FIG. 16, a still further embodiment of the core portion 58 is there shown in which the metal laminations 170 vary between adjacent metal laminations 170 thereby closely approximating a circular shape. As such, the core portion 58 illustrated in FIG. 16 is the most efficient magnetic core portion of the embodiments illustrated in FIGS. 13–16. However, because each separate lamination on each half of the core portion 58 of FIG. 16 requires a different size lamination, the manufacturing cost for the core portion illustrated in FIG. 16 is higher than the other embodiments of FIGS. 13–15.

Since the core portion 58 approximates a circular shape, both the primary coil assembly 50 and secondary coil assembly 52 may be of circular shape thus maximizing the magnetic efficiency of the ignition system of the present invention. Furthermore, by the use of the tubular and cylindrical bobbins 64 and 80 for the primary and secondary coil assemblies 50 and 52, respectively, the manufacturing of the coil assemblies 50 and 52 is both simple and cost effective.

Although the cores may be made of metal laminations, the core portion 144 (FIG. 11) and core portion 160 (FIG. 12) may alternatively comprise a cylindrical ferrite core.

Having described my invention, however, many modifications thereto will become apparent to those skilled in the art to which it pertains without deviation from the spirit of the invention as defined by the scope of the appended claims.

We claim:

1. An ignition coil assembly for a spark plug having a terminal comprising:

a. housing, said housing forming a first tubular cavity cylindrical in cross sectional shape and having a first axis and a second tubular cavity rectangular in cross sectional shape, and having a second axis, said axes being spaced apart and parallel to each other, a tubular and cylindrical primary coil having an interior, said primary coil being mounted within said first cavity of said housing, a tubular and cylindrical secondary coil having an interior, said secondary coil being mounted within said first cavity of said housing so that said primary and secondary coils are coaxial and magnetically coupled with each other, a magnetic core having a first portion extending coaxially through an interior of said coils and a second portion extending through said second cavity of said housing exteriorly of said coils wherein said magnetic core is constructed from a plurality of stacked laminations and having a top lamination and a bottom lamination, said laminations of said first portion of said magnetic core increasing in width from said top and bottom laminations and toward a center lamination of said core, said second portion of said magnetic core being rectangular in cross sectional shape.

2. The invention as defined in claim 1 wherein said core comprises a first section and a second section, said core sections being secured together to form said core.

3. The invention as defined in claim 1 wherein said core includes an air gap between one end of said first core section and one end of said second core section.

4. The invention as defined in claim 3 and comprising magnetic material disposed in said air gap.

5. The invention as defined in claim 1 wherein said laminations are constructed from steel laminations.

6. The invention as defined in claim 2 wherein said first core section is generally U-shaped having one end portion which is substantially circular in cross sectional shape and a second end portion which is substantially rectangular in cross sectional shape, and said second core section is substantially L-shaped having one end secured to said second end portion of said first core section and a second end spaced from said first end portion of said first core section and forming an air gap therebetween.

7. The invention as defined in claim 6 and comprising a magnetic material disposed in said air gap.

8. The invention as defined in claim 1 wherein said core comprises a first, second and third sections, said core sections being secured together to form said core.

9. The invention as defined in claim 1 wherein said first core section is cylindrical in shape and positioned through said coils, and wherein said second and third core sections are L-shaped.

10. The invention as defined in claim 9 wherein a first end of said first core section is spaced from one end of said second core section thus forming a first air gap therebetween and wherein a second end of said first core section is spaced from one end of said third core section thus forming a second air gap therebetween.

11. The invention as defined in claim 1 and comprising a magnetic material disposed in each air gap.

12. The invention as defined in claim 1 wherein each coil comprises a bobbin and wire wound around each said bobbin.

13. The invention as defined in claim 12 wherein each bobbin is circular in cross sectional shape.

14. The invention as defined in claim 14 where said primary coil bobbin is coaxially positioned within said secondary coil bobbin.

15. The invention as defined in claim 14 wherein said secondary coil bobbin includes a plurality of radially inwardly extending ribs and wherein said primary coil bobbin includes at least one radially outwardly extending tab, said tab cooperating with said ribs to angularly orient said primary coil bobbin relative to said secondary coil bobbin.

16. The invention as defined in claim 1 and comprising a potting material for securing said coils to said housing.

17. The invention as defined in claim 1 and comprising an ignition controller mounted in said housing and electrically connected to said primary coil.

18. The invention as defined in claim 1 wherein said first portion of said magnetic core comprises a ferrite core.

19. The invention as defined in claim 18 wherein said ferrite core is cylindrical in shape.

* * * * *